US006647746B2

(12) United States Patent
Bosque et al.

(10) Patent No.: US 6,647,746 B2
(45) Date of Patent: Nov. 18, 2003

(54) DECORATIVE OBJECT WITH A MOVEABLE SLEEVE

(75) Inventors: Luis Bosque, Chavannes de Bogis (CH); Claude Seiler, Aire Geneve (CH)

(73) Assignee: Richemont International SA, Villars-sur-Glane (CH)

( * ) Notice: Subject to any disclaimer, the term of this patent is extended or adjusted under 35 U.S.C. 154(b) by 0 days.

(21) Appl. No.: 10/345,195

(22) Filed: Jan. 16, 2003

(65) Prior Publication Data

US 2003/0101746 A1 Jun. 5, 2003

Related U.S. Application Data

(63) Continuation of application No. 09/703,799, filed on Nov. 2, 2000, now Pat. No. 6,560,993.

(30) Foreign Application Priority Data

Nov. 8, 1999 (CH) ..... 2041/99

(51) Int. Cl.[7] ..... A44C 5/00
(52) U.S. Cl. ..... 63/3; 63/15
(58) Field of Search ..... 63/3, 2, 15, 15.4, 63/31, 26

(56) References Cited

U.S. PATENT DOCUMENTS

| | | | | |
|---|---|---|---|---|
| 1,324,524 A | | 12/1919 | Silver | |
| 1,327,606 A | * | 1/1920 | Bacharach | 63/15.2 |
| 3,273,766 A | | 9/1966 | Cosentino | |
| 4,294,084 A | | 10/1981 | Lampert | |
| 4,305,262 A | | 12/1981 | Ferrara | |
| 4,551,993 A | | 11/1985 | Nagahori | |
| 4,977,757 A | | 12/1990 | Mesica et al. | |
| 4,989,420 A | | 2/1991 | Reinhold et al. | |
| 5,069,045 A | | 12/1991 | Mejias | |
| 5,161,392 A | * | 11/1992 | Wiriath et al. | 63/15.7 |
| 5,678,428 A | * | 10/1997 | Pasquetti | 63/15.2 |
| 5,816,072 A | | 10/1998 | Michael | |
| 5,873,265 A | | 2/1999 | Simonnet | |
| 5,896,757 A | | 4/1999 | Kharloubian | |
| 5,987,919 A | | 11/1999 | Hooser | |
| 6,032,485 A | | 3/2000 | Steinberg | |
| 6,101,843 A | * | 8/2000 | Nagano | 63/15.4 |
| 6,167,726 B1 | | 1/2001 | Kremer | |
| 6,295,732 B1 | | 10/2001 | Ofiesh, II | |

FOREIGN PATENT DOCUMENTS

DE 197 41 582 3/1999

* cited by examiner

*Primary Examiner*—William L. Miller
*Assistant Examiner*—Dinesh Melwani
(74) *Attorney, Agent, or Firm*—Young & Thompson

(57) ABSTRACT

A decorative object, particularly jewelry such as a ring, includes an annular body on which is slidably mounted a movable member having the shape of a sleeve. Slideways are provided in a hollow annular space of the annular body and coact with shoes secured to the sleeve. Thus, the sleeve does not touch the visible external surface of the annular body.

13 Claims, 4 Drawing Sheets

DECORATIVE OBJECT WITH A MOVEABLE SLEEVE

This application is a continuation of U.S. application Ser. No. 09/703,799 filed Nov. 2, 2000 now U.S. Pat. No. 6,560,993.

BACKGROUND OF THE INVENTION

The present invention relates to a decorative object, particularly of jewelry, comprising an annular body and at least one movable member mounted slidably on this annular body.

There are already known rings comprising a movable member mounted on at least one ring, the piece and the ring being adapted to move relative to each other. During this relative movement, the external visible surface of the ring is rapidly scratched and accordingly loses its brilliant and aesthetic appearance.

SUMMARY OF THE INVENTION

The present invention has for its object to overcome the mentioned drawbacks and it is characterized to this end by the fact that the annular body comprises a visible external portion, a second portion directed toward a support on which the object can be disposed, and at least one slideway, and by the fact that the movable portion comprises a portion surrounding at least partially the annular body and at least one shoe secured to said portion and adapted to coact with the slideway or slideways such that the internal surface of said portion does not touch the external visible portion of the annular body.

With these characteristics, the visible external portion of the annular body is preserved from any scratching and remains intact and shiny, even during repeated and frequent sliding of the movable member. The movement of this latter is moreover regular and facilitated and the guiding and sliding elements are hidden, which contributes to the aesthetic appearance of the object.

A preferred embodiment is characterized by the fact that the slideway or slideways are constituted by at least two opposed grooves provided in an annular hollow space of the second portion of the annular body and by the fact that the shoe or shoes comprise a T-shaped slider disposed at least partially in the hollow annular space and secured to said portion.

These characteristics ensure a slide mechanism that is entirely hidden, hence a particularly favorable aesthetic appearance, whilst permitting easy sliding of the movable member on the annular body.

Preferably, the movable piece comprises two shoes provided at each of its ends, ensuring regular sliding of the movable member on the annular body without contact of said portion with the visible external portion of the annular body.

The guidance of the movable member on the annular body is thus particularly precise.

According to a preferred embodiment, said portion is constituted by at least one sleeve at least partially surrounding the annular member.

These characteristics permit obtaining faultless operation and at the same time impeccable aesthetic qualities.

The annular body can be shaped so as to constitute a ring, a bracelet, an earring or a necklace.

According to another modification, said portion is secured to a soft resilient member, such as a felt, of velour or another fabric, disposed between its internal surface and the visible external portion of the annular body.

Possible play between the movable member and the annular body can be eliminated, from which results a particularly even sliding. There is simultaneously obtained a cleaning and polishing of the annular body by sliding of the movable member. This resilient member serves also as a brake such that the movable member will not slide accidentally.

BRIEF DESCRIPTION OF THE DRAWINGS

Other objects will become apparent from the characteristics set forth in the dependent claims and the description hereafter of the invention in greater detail with the aid of the drawings which represent schematically and by way of example one embodiment and some variations.

DESCRIPTION OF THE PREFERRED EMBODIMENTS

Figure 1:
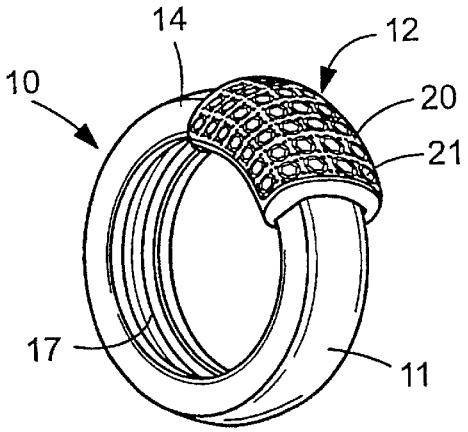
FIGS. 1 and 2 are two perspective views of this embodiment.
Figure 2:
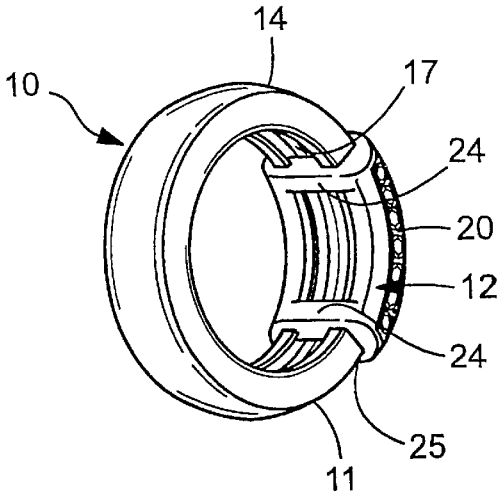
Figure 3:
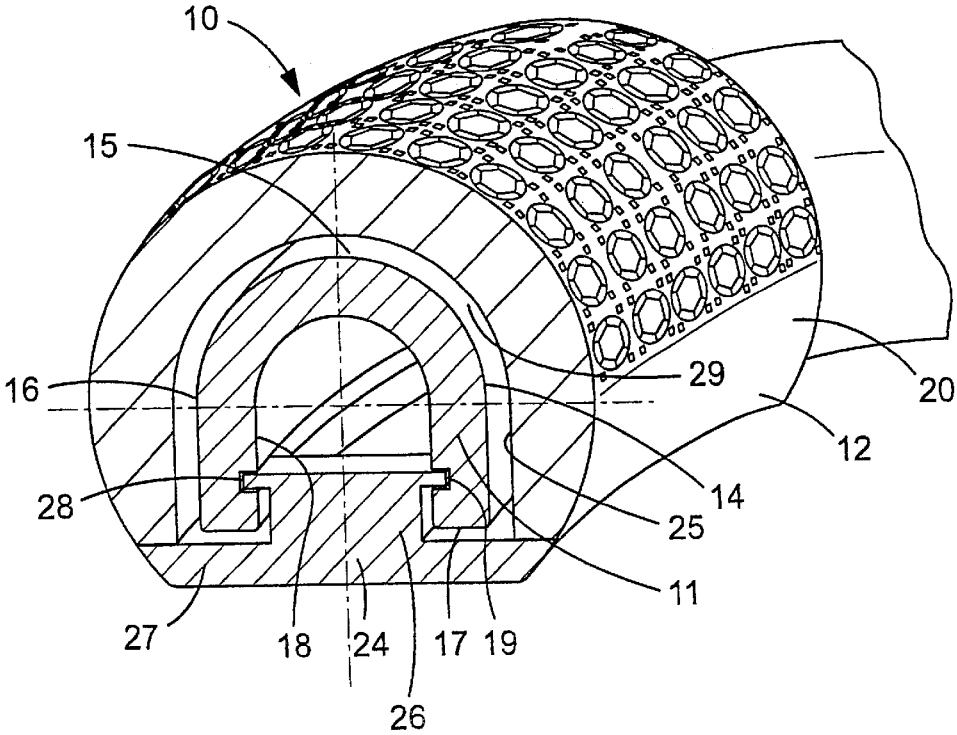
FIG. 3 is a fragmentary cross-sectional view of this embodiment.
Figure 4:
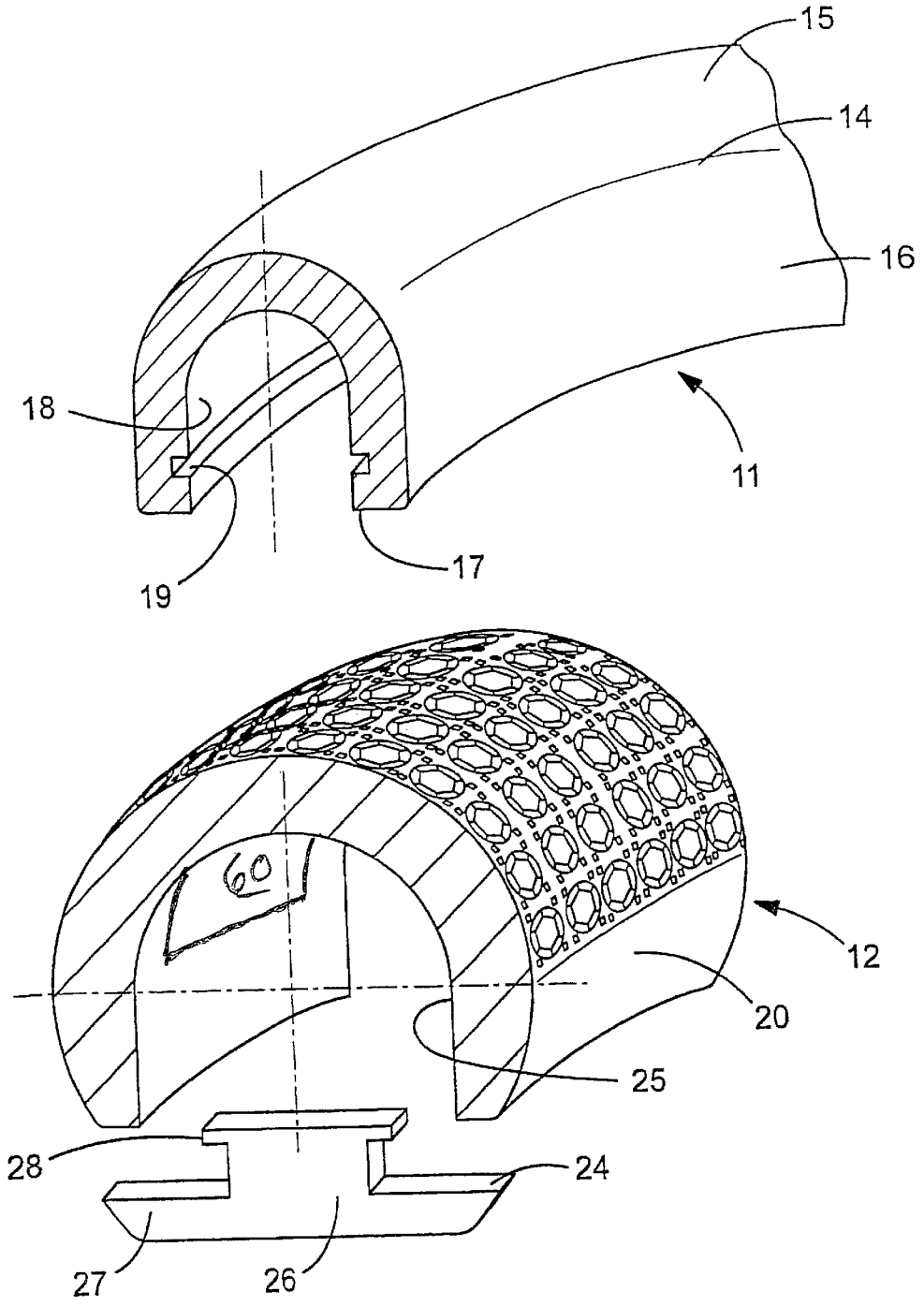
FIG. 4 is a fragmentary exploded cross-sectional view of this embodiment.

The decorative object shown in FIGS. 1 to 4 is an object of jewelry, namely a ring 10. This latter comprises an annular body 11 on which is slidably mounted a movable member 12. The annular body 11 has a visible external portion 14 with an upper surface 15 and side surfaces 16 and a second portion 17 directed inwardly, hence toward the finger or the support on which the ring 10 is disposed. This second portion 17 comprises a hollow annular space 18 in which are provided two opposed grooves 19 in the ring 10 to form slideways.

The movable piece 12 is constituted by a sleeve 20 slidably mounted on the annular body 11. The length of this sleeve 20 is less than a quarter of the circumference of the annular body 11. The sleeve 20 is provided with decorative elements and/or stones 21 set in its external surface. At its internal portion, it comprises two shoes 24 fixed its two lower side ends, ensuring regular sliding of the sleeve 20 on the annular body 11, without the internal surface 25 of the sleeve touching the visible external portion 14 of the annular body 11.

The shoes 24 are for this purpose formed by two sliders 26 of T-shape disposed at least partially in the annular hollow space 18 of the annular body 11. Two ribs of the shoes are secured to the sleeve 20, whilst two other ribs 28 coact with the two grooves 19.

Because the sleeve 20 does not touch the visible external portion 14 of the annular body 11, but is separated from this latter by an annular space 29 of a small width (0.1 to 0.5 mm), the visible external portion 14 of the annular body 11 cannot be scratched during sliding of the sleeve. It thus remains perfectly intact and shiny. When the ring is worn, the guide and sliding elements, namely the slideways 19 and the shoes 24, are not visible, but hidden.

Figure 5:
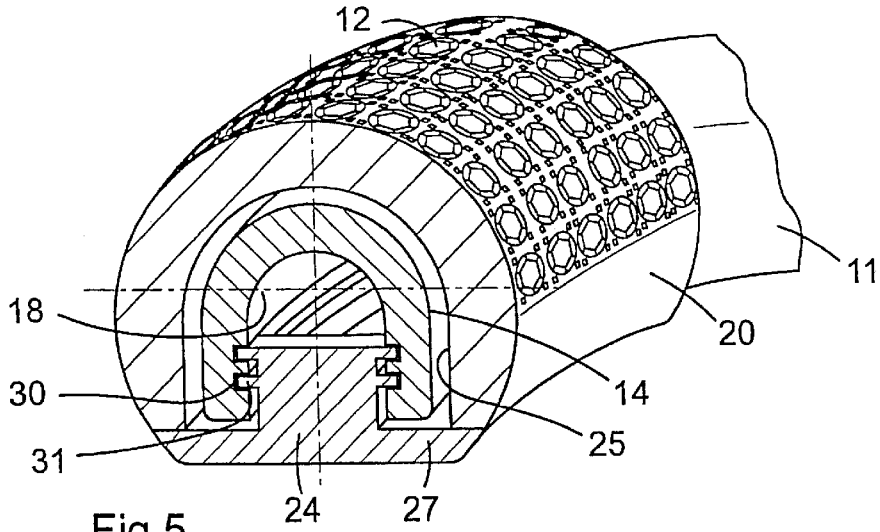
FIGS. 5 and 6 show two modifications in partial cross-section.

The modification shown in FIG. 5 differs from the preceding embodiment only by the construction of the slideways and the shoes. The hollow annular space 18 in this case comprises two pairs of two opposed slideways 30 coacting with two pairs of two projecting members 31 provided on the shoes 24 secured by their ribs 27 to the sleeve 20. These shoes and double slideways ensure a very secure sliding of the sleeve 20 without any risk of swinging.

Figure 6:
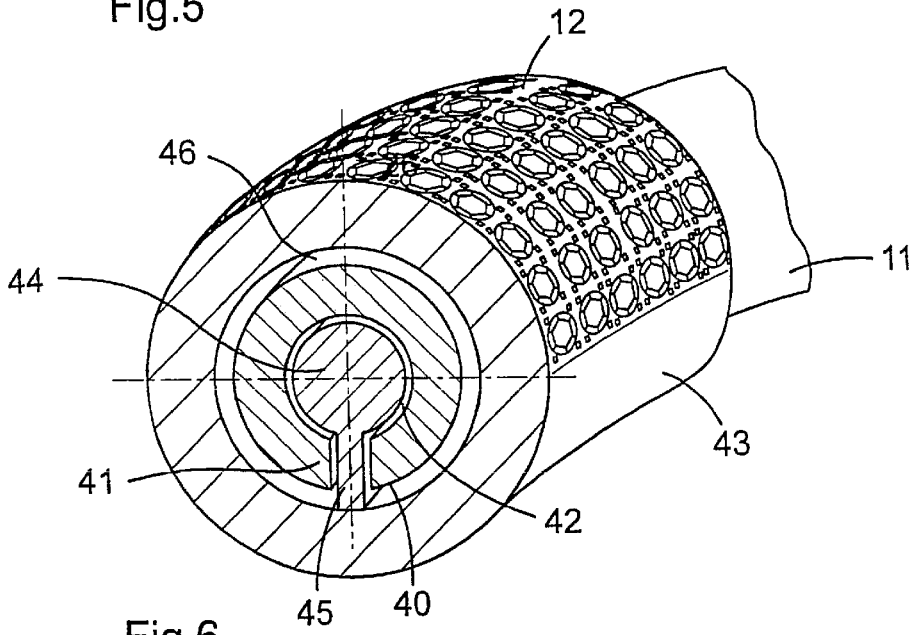

The modification shown in FIG. 6 again comprises an annular body 11 and a movable member 12 mounted slidably on this annular body which has an internal portion 40 directed toward the finger. This internal portion comprises an annular opening 41 that opens into a central annular space 42. The movable member 12 is constituted by a sleeve 43 completely surrounding the annular body. This sleeve is secured to a shoe 44 of a cross-section adapted to that of the annular central space 42 to slide in it with very small play. A connecting member 45 traverses with very small play the annular opening 41 to connect the shoe 44 to the sleeve 43. Thus an annular space 46 of a small width (0.1 to 0.5 mm) is formed such that the internal surface of the sleeve does not touch the visible external surface of the annular body, which accordingly cannot be scratched during sliding.

Figure 7:
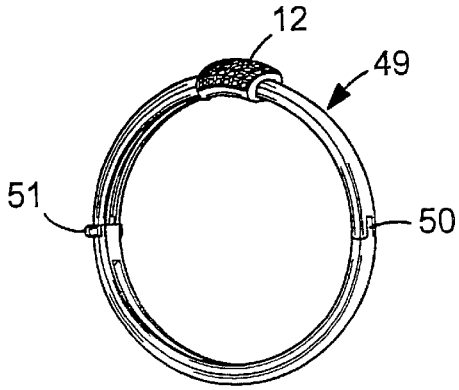
FIGS. 7 and 8 are perspective views of two other modifications.

FIG. 7 shows another modification in which the annular body 49 can be open thanks to a hinge 50 and a closure 51. The hinge 50 is preferably arranged such that the movable member can pass through it. This modification could for example be used for necklaces, bracelets or even earrings.

Figure 8:
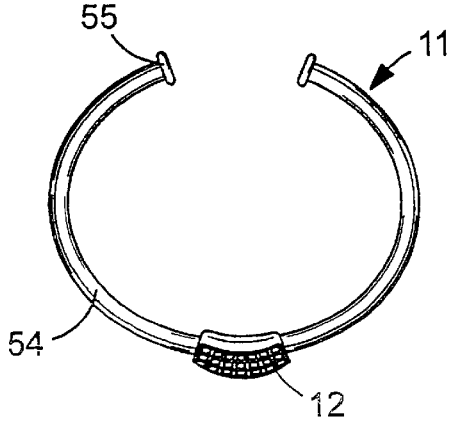

In another modification shown in FIG. 8, the annular body 11 forms only a partial circle 54, for example for a necklace or a bracelet. The ends of this partial circle are closed by end members 55 adapted to prevent the movable member from falling off the annular body.

Figure 9:
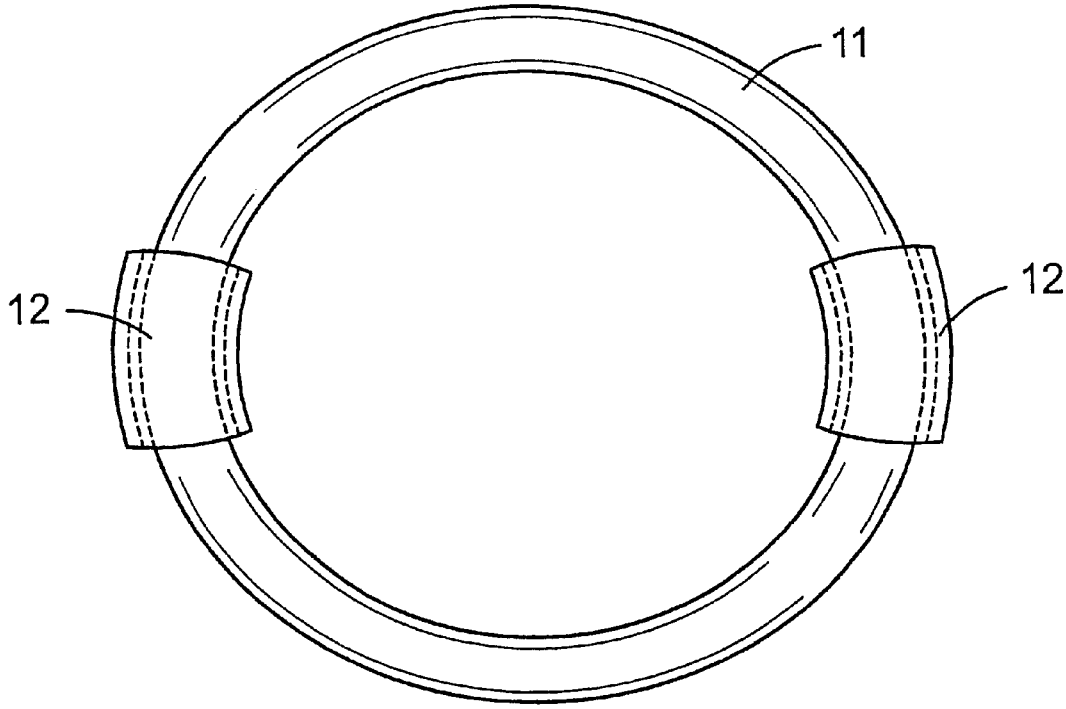
FIG. 9 shows a fifth modification in a top plan view.

The modification of FIG. 9 is a decorative object to be disposed on a support, such as a curio, and has an annular body 11 on which two movable members 12 are mounted slidably. The slideway and the shoe are invisible, seen from above, because they are arranged in the lower portion facing the support of the object. They can be constituted in a manner similar to the construction shown in FIG. 3.

Of course the embodiments described above are not limiting and can be the subject of all desirable modifications within the scope defined by claim 1. In particular, the annular body could have a generally non-spherical shape, but could be oval, U-shaped, etc. The hollow annular space of the annular body could have a very different cross-section, but shaped to adapt it to the shape of the shoe. There could also be provided two or more concentric annular bodies on which one or several movable pieces are arranged, according to the characteristics of the invention. The invention could also be used in all types of decorative objects or jewelry, such as brooches. It is also possible to provide a soft resilient member, such as a felt, velour, or another cloth, in the annular space 29 between the annular body and the movable member. This member, which is secured to the movable member, permits taking up any play between the movable piece and the annular body and permits cleaning and polishing this latter by sliding of the movable member. This member thus ensures regular sliding and serves simultaneously as a brake to prevent accidental undesired movement of the movable member. Because this member permits resiliently eliminating the sliding play between the shoes and the slideways, these latter can be produced with relatively large tolerances.

What is claimed:

1. A decorative object, comprising:

a continuous annular ring having a visible external portion and a hollow internal space that opens radially inward, the internal space defining a slideway; and a sleeve surrounding said ring and being slideably mounted on said ring, said sleeve having a visible external surface and an internal surface that faces said external portion of said ring, said sleeve further having a slide projecting into said internal space of said ring and engaging said slideway, said slide and said slideway being arranged so that said internal surface of said sleeve is spaced from said external portion of said ring while said sleeve slides on said ring.

2. The decorative object of claim 1, wherein said slideway comprises two opposed grooves and said slide is T-shaped with distal ends engaging said grooves.

3. The decorative object of claim 1, wherein said sleeve comprises one said slide at one end of said sleeve and a second said slide at an opposite end of said sleeve.

4. The decorative object of claim 1, wherein said sleeve has a length that is less than one quarter of a circumference of said ring.

5. The decorative object of claim 1, wherein said external surface of said sleeve comprises at least one of decorative elements and set stones.

6. The decorative object of claim 1, wherein the object is one of a finger ring, a bracelet, an earring, and a necklace.

7. The decorative object of claim 1, wherein said slideway extends completely around said ring so that said sleeve freely slides completely around said ring.

8. The decorative object of claim 7, wherein said slideway comprises two opposed grooves and said slide is T-shaped with distal ends engaging said grooves.

9. The decorative object of claim 7, wherein said sleeve comprises one said slide at one end of said sleeve and a second said slide at an opposite end of said sleeve.

10. The decorative object of claim 1, wherein said internal space of said ring has a first said slideway and a second said slideway radially inward from said first slideway and said slide engages both said first and second slideways.

11. A decorative object, comprising:

an annular body having a visible external portion and an internal space that opens radially inward, the internal space defining in cross section a hollow arch-shaped slideway with grooves in opposing sides thereof; and a sleeve around and slideably mounted on said body, said sleeve having a visible external surface and an internal surface that faces said external portion of said body, said sleeve further having a T-shaped slide projecting into said internal space of said body with distal ends engaging said grooves in said slideway, said slide and said slideway being arranged so that said internal surface of said sleeve is spaced from said external portion of said body while said sleeve slides on said body.

12. The decorative object of claim 11, wherein each of the opposing sides of said hollow arch-shaped slideway has two of said grooves therein and wherein said slide has four projections that engage said grooves.

13. The decorative object of claim 11, wherein said annular body is an inverted U-shape in cross section and a closed end of said U-shape is said external portion.

* * * * *